US010781588B1

(12) United States Patent
Nadeau

(10) Patent No.: US 10,781,588 B1
(45) Date of Patent: Sep. 22, 2020

(54) INTEGRATED, POST-TENSIONED, BUILDING CONSTRUCTION SYSTEM

(71) Applicant: Marc R Nadeau, St. Petersburg, FL (US)

(72) Inventor: Marc R Nadeau, St. Petersburg, FL (US)

( * ) Notice: Subject to any disclaimer, the term of this patent is extended or adjusted under 35 U.S.C. 154(b) by 0 days.

(21) Appl. No.: 16/240,842

(22) Filed: Jan. 7, 2019

Related U.S. Application Data

(60) Provisional application No. 62/621,636, filed on Jan. 25, 2018.

(51) Int. Cl.

| | |
|---|---|
| ***E04B 2/18*** | (2006.01) |
| ***E04C 5/16*** | (2006.01) |
| ***E04C 5/01*** | (2006.01) |
| *E04B 2/02* | (2006.01) |

(52) U.S. Cl.
CPC ..... *E04B 2/18* (2013.01); *E04C 5/01* (2013.01); *E04C 5/163* (2013.01); *E04B 2002/0247* (2013.01)

(58) Field of Classification Search
CPC ..... E04B 2/18; E04B 2002/0247; E04B 2002/027; E04B 5/48; E04B 2/20; E04B 2002/0254; E04C 5/01; E04C 5/163
USPC ..... 52/223.4, 223.5, 223.7
See application file for complete search history.

(56) References Cited

U.S. PATENT DOCUMENTS

| | | | | |
|---|---|---|---|---|
| 1,704,255 A * | 3/1929 | Lewis | E04B 2/14 | 52/293.2 |
| 3,504,408 A | 4/1970 | Jones | | |
| 3,618,279 A * | 11/1971 | Sease | E04B 2/46 | 52/223.7 |
| 4,314,431 A * | 2/1982 | Rabassa | E04B 2/46 | 52/259 |
| 4,573,301 A * | 3/1986 | Wilkinson | E04B 2/18 | 52/220.2 |

(Continued)

FOREIGN PATENT DOCUMENTS

CA 2846735 A1 * 9/2014 ..... E04C 1/41

*Primary Examiner* — Beth A Stephan
(74) *Attorney, Agent, or Firm* — Thomas Frost

(57) ABSTRACT

The present invention relates an integrated, post-tensioned building construction system that utilizes a rectangular array of interlocking block components for the shell of building structures. Internal tendons that pass through the interlocking blocks are affixed to beams at the base or foundation of the building walls and terminate above beams atop the building walls. The ends of tendons receive mechanical fasteners that are tightened to the beams and/or foundation. The tendons serve to maintain the integrity of the interlocking block components, which cannot come apart when the tendons are tightened. Build stops secured to tendons help to stabilize the interlocking block components during construction. With interlocking blocks fabricated from a compressible material, like concrete-and-aggregate, the tendons are tensioned to induce a compressive load on the material. Inducing compression in the structure by tensioning the internal tendons augments the strength of the entire building by introducing an internal compressive stress that partially counteracts the tensile stresses caused by external loads applied to the structure, such as by windstorms, seismic events, or settling of the foundation.

11 Claims, 13 Drawing Sheets

(56) References Cited

U.S. PATENT DOCUMENTS 5,402,609 A 4/1995 Kelley, Jr.
5,421,135 A * 6/1995 Stevens ..... E04B 2/16 405/284
5,794,921 A * 8/1998 Greenberg ..... E04H 17/1404 256/19
5,881,511 A 3/1999 Keller, Jr.
5,901,520 A 5/1999 Abdul-Baki
6,088,987 A * 7/2000 Simmons ..... E04B 2/14 405/285
6,161,357 A * 12/2000 Altemus ..... E04B 2/18 446/124
6,571,525 B2 * 6/2003 Coleman ..... E04B 2/08 446/125
6,588,168 B2 * 7/2003 Walters ..... E04B 2/14 52/604
6,758,020 B2 * 7/2004 Cerrato ..... E04B 1/703 52/223.7
6,912,823 B2 * 7/2005 MacDonald ..... E02D 29/0241 405/262
7,905,070 B2 3/2011 August
8,091,300 B2 1/2012 Pyo
8,225,578 B2 * 7/2012 Azizi Ronagh ..... E04B 2/16 52/285.2
8,297,012 B2 * 10/2012 Nunez-Vargas ..... E04B 1/165 52/223.7
2002/0014050 A1 * 2/2002 Van Der Heijden ..... E04B 2/08 52/585.1
2004/0020145 A1 * 2/2004 Matsufuji ..... E04B 2/42 52/223.7
2005/0252118 A1 * 11/2005 Matsufuji ..... E04B 2/02 52/223.7
2005/0257459 A1 * 11/2005 Schieffer ..... B25B 9/00 52/223.7
2006/0201082 A1 * 9/2006 Hammer ..... E04C 1/395 52/223.5
2007/0079566 A1 * 4/2007 Neill ..... E04B 2/46 52/284
2008/0216436 A1 * 9/2008 Rodriguez Carassus ..... E04B 2/06 52/588.1
2009/0313923 A1 * 12/2009 Bucheger ..... E04B 2/44 52/223.7
2015/0192225 A1 7/2015 Vo
2016/0369499 A1 * 12/2016 Crumley ..... E04B 2/16
2018/0328030 A1 * 11/2018 Walter ..... E04B 2/18

* cited by examiner

INTEGRATED, POST-TENSIONED, BUILDING CONSTRUCTION SYSTEM

BACKGROUND OF INVENTION

The present invention relates to an integrated, post-tensioned, construction system for building structures that utilizes horizontally and vertically interlocking components, which are held in place and strengthened by tensioned internal tendons secured to beams in way of the top and the base of the structure. Connection of the interlocking components with adhesives or mortars is obviated. The system is more resistant to wind storm and seismic damage than conventional structures that use bonding agents for affixing building elements.

A building structure consists of a shell made from different interrelated parts with a fixed location on the ground. Some embodiments of building structures include agricultural barns, airport hangars, churches, clinics, commercial buildings, garages, government offices, greenhouses, hospitals, military barracks, museums, prisons, railway stations, residential houses, schools, silos, and warehouses. In contrast to building structures, civil engineering structures span between, facilitate access to, or protect geographical features. Some embodiments of civil engineering structures include abutments, aqueducts, bridges, dams, highway interchanges, tunnels, and viaducts.

Traditional building construction most often uses concrete-and-aggregate blocks that are held in place with cement mortar. When the mortar cures, it is approximately half the strength of the cured concrete-and-aggregate used in the blocks. Civil engineering structures most often utilize pre-stressed and/or post-tensioned tendons in pre-cast concrete-and-aggregate structures to augment the overall strength of the fabrication by introducing internal compressive stress to partially counteract tensile stresses caused by loads on the structure. This option has not been available for anisotropic, traditionally constructed, building structures, because of the disparity in strength between the concrete-and-aggregate blocks and the cement mortar.

When the walls of the building structure are assembled to the requisite height, the present invention uses a course of interlocking cap blocks above the interlocking blocks forming the walls. On top of the interlocking cap blocks, a structural beam is laid to connect to the top of tendons placed inside the walls. The bottom of the tendons is affixed to the foundation or to a structural beam below a course of interlocking base blocks in way of the foot of the wall. The tendons are tensioned by torquing fasteners in way of the beam above the interlocking cap blocks. The requisite tensioning of the tendons is dependent on the properties of the materials from which the interlocking components and the structural beam(s) are made. The interlocking components of the present invention may be made from virtually any curable or kiln-dried material that is currently being used in building structures; however, concrete-and-aggregate will be the most frequent embodiment. Concrete by itself is a weak binder that is similar to cement mortar. Cured concrete-and-aggregate forms a material that is strongest in compression, and the compression induced by the tensioned tendons augments the strength of the whole structure.

Construction using block, brick, or stone with cement mortar was invented in the late $18^{th}$ century and has been used since that time with minor changes. Blocks or bricks are laid by skilled tradespeople called masons, who must take care to maintain a uniform thickness of the mortar seams and keep the rows of blocks or bricks level as construction progresses. The time required for construction is determined by the ability of the mason laying the blocks or bricks and the requisite time for the mortar to cure until it will support the weight of the structure. A significant portion of the cost of construction is remuneration of the skilled masons and the construction personnel, whose job time is influenced by the ability of the masons and the curing time of the mortar.

Utilization of the present invention eliminates the need for masons, because the interlocking blocks do not require mortar for assembly and are self-leveling. When the first course of interlocking blocks is placed on the foundation or on the base blocks in the proper orientation, the subsequent rows of interlocking blocks may be laid serially until the building is complete. This task may be done quickly by semi-skilled tradespeople.

In addition to the reduced labor for fabrication, the cost of construction is further reduced relative to traditional construction through reuse of components. If a building structure is to be taken down, the interlocking components may be disassembled for reuse. Similarly, if a building is partially damaged by a windstorm or seismic event, the undamaged components may be reused in a repair or a rebuild. Due to the aging properties of concrete, components taken from pre-existing buildings are significantly stronger than newly cured components, so disassembly is preferable to demolition.

The present invention is pan-global in application. The interlocking components may be made serially in the field or mass-produced through utilization of automation in a factory using engineered tooling in concrete-block-making machines. Do-it-yourself component fabrication and construction avails application of the system to most people in the world. In locations where infrastructure is limited, construction components may be transported utilizing draft animals, carts, boats, or other such conveyances.

SUMMARY OF THE INVENTION

The general purpose of the present invention, which will be described subsequently in greater detail, is to provide a new system for constructing building structures using post-tensioned, integrated components.

To attain this, the present invention uses interlocking blocks that are laid serially on a foundation to form the shell of a building structure. Some embodiments of the foundation may be reinforced-concrete, structural beams, or compacted-soil. When using a compacted-soil foundation, a bottom course of interlocking base blocks is laid that engages with the full-size and half-size interlocking blocks that form the walls. Full-size and half-size interlocking blocks are laid successively until the wall structure attains the requisite height. The top row of full-size and half-size interlocking blocks is overlaid with a course of interlocking cap blocks that engage with the interlocking features of the blocks forming the wall. Tendons are located inside hollow spaces inside the blocks. Below the base blocks and above the cap blocks are located pultruded, extruded, or composite structural beams that connect to the tendons. The ends of the tendons are mechanically fastened to the beams.

The wall built from of the interlocking blocks with internal tendons mechanically fastened to structural beams above-and-below the wall forms a composite structure that does not require mortar or adhesives to join together individual elements. Proper alignment is achieved through utilization of the interlocking features of the blocks. The tendons hold together the interlocking blocks that form the shell of the building. During construction, build stops are fitted below joints in the tendons to help stabilize the wall and to center the tendon in the openings in the interlocking blocks. When the end fasteners on the tendons are tightened to the structural beam(s) and/or foundation, the interlocking blocks cannot come apart, since the entire structure is mechanically connected.

Post-tensioning of the structure is performed by applying torque to the fasteners in way of the upper ends of the tendons where they connect to the structural beams. The tensioned tendons induce compression in the interlocking blocks between the top and bottom structural beams or between the top structural beam and the foundation. The amount of torque applied to the fasteners on the tendons is dependent on the strength of materials used in the blocks and the beams. The induced compression on the walls forms an internal stress that partially counteracts the tensile stresses caused by external loads on the structure. This improved ability of the structure to support loads beyond its own dead weight enables better performance when external loads are applied, such as by windstorms, seismic events, or settling of the foundation of the structure.

BRIEF DESCRIPTION OF THE DRAWINGS

The invention will be better understood and objects other than those set forth above will become apparent when consideration is given to the following detailed description thereof. Such description makes reference to the annexed drawings wherein.

Figure 1:
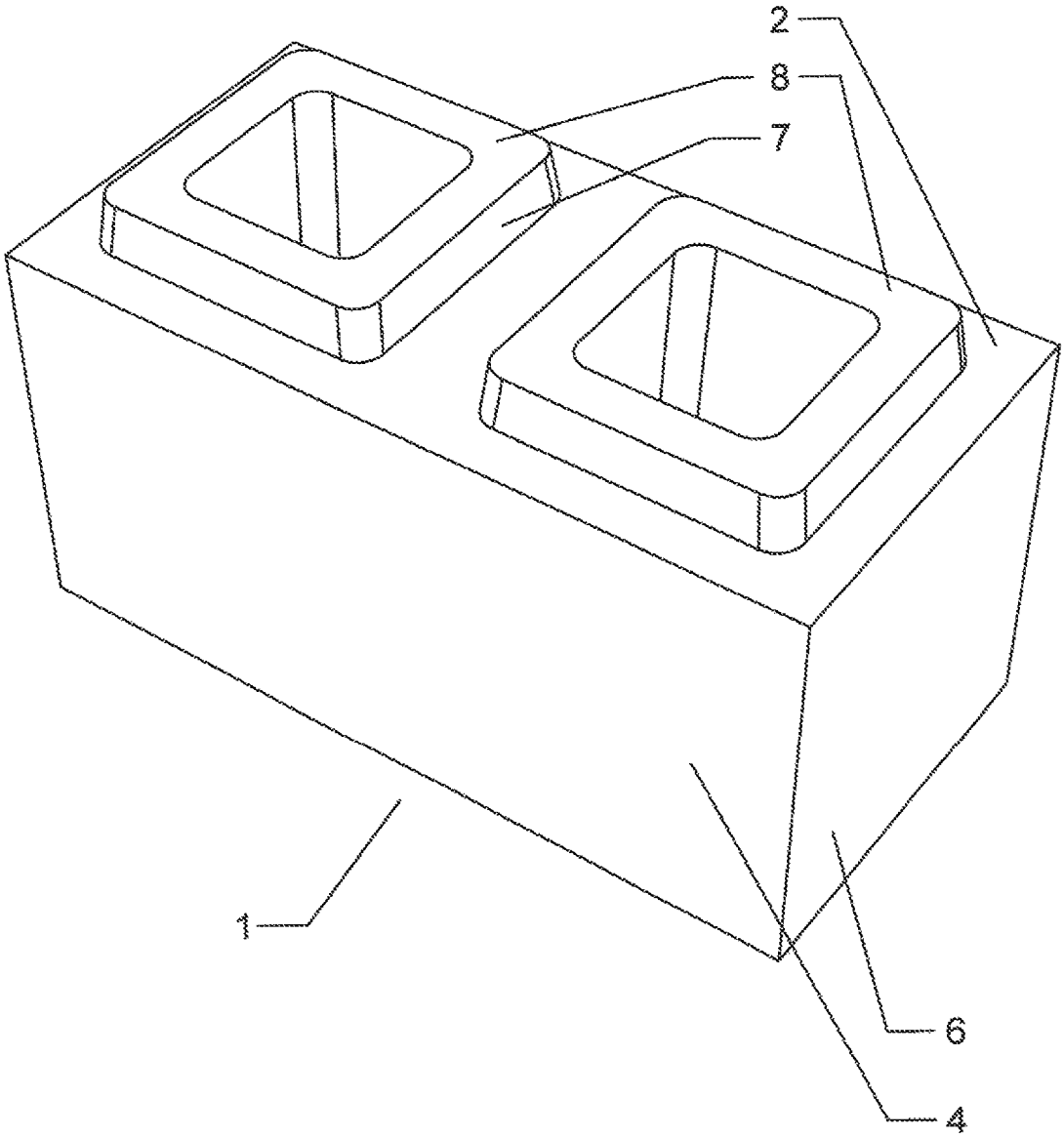
FIG. 1 is a top right perspective view of the full-size interlocking block.

| REFERENCE NUMERALS IN FIGS. | |
|---|---|
| 1 | Fill -size Interlocking Block (FIB) |
| 2 | Top Face of FIB |
| 3 | Bottom Face of FIB |
| 4 | Front Face of FIB |
| 5 | Back Face of FIB |
| 6 | Side Wall of FIB |
| 7 | Bosses of FIB |
| 8 | Top Faces of Bosses of FIB |

-continued

| REFERENCE NUMERALS IN FIGS. | |
|---|---|
| 9 | Passages of FIB |
| 10 | Half-size Interlocking Block (HIB) |
| 12 | Top Face of HIB |
| 13 | Bottom Face of HIB |
| 14 | Front Face of HIB |
| 15 | Back Face of HIB |
| 16 | Side Wall of HIB |
| 17 | Boss of HIB |
| 18 | Top Face of Boss of HIB |
| 19 | Passage of HIB |
| 20 | Cap Interlocking Block (CIB) |
| 21 | Top of Recesses of CIB |
| 22 | Top Face of CIB |
| 23 | Bottom Face of CIB |
| 24 | Front Face of CIB |
| 25 | Back Face of CIB |
| 26 | Side Wail of CIB |
| 28 | Passages for Tendon of CIB |
| 29 | Recesses of CIB |
| 30 | Base Interlocking Block (BIB) |
| 32 | Top Face of BIB |
| 33 | Bottom Pace of BIB |
| 34 | Front Face of BIB |
| 35 | Back Face of BIB |
| 36 | Side Wall of BIB |
| 37 | Bosses of BIB |
| 38 | Passages for Tendon of BIB |
| 39 | Top Faces of Bosses of BIB |
| 50 | Seal Ply |
| 52 | J-Bolt Anchor |
| 54 | Expansion BoltAnchor |
| 56 | Earthnchor |
| 58 | Top Beam |
| 60 | Bottom Beam |
| 62 | Concrete Foundation |
| 64 | Soil Foundation |
| 66 | Tendon |
| 68 | Nut |
| 70 | Tendon Coupling |
| 72 | Build Stop |
| 74 | Build Stop Nut |
| 76 | Flat Washer |
| 78 | Lock Washer |

DETAILED DESCRIPTION OF THE INVENTION

In reference to FIGS. 1-8, the interlocking block components of an integrated, post-tensioned, building construction system are shown. In some embodiments, the interlocking block components may be made from concrete-and-aggregate, structural clay, or adobe (mud-bricks). The mechanical fit between adjacent blocks provides the horizontal and vertical integration of the wall structure. Interlocking is accomplished when the raised boss on the top of a block engages with a matching opening in the bottom of a passage through an adjacent block. The interior of the blocks is hollowed to reduce weight while maintaining strength.

Figure 2:
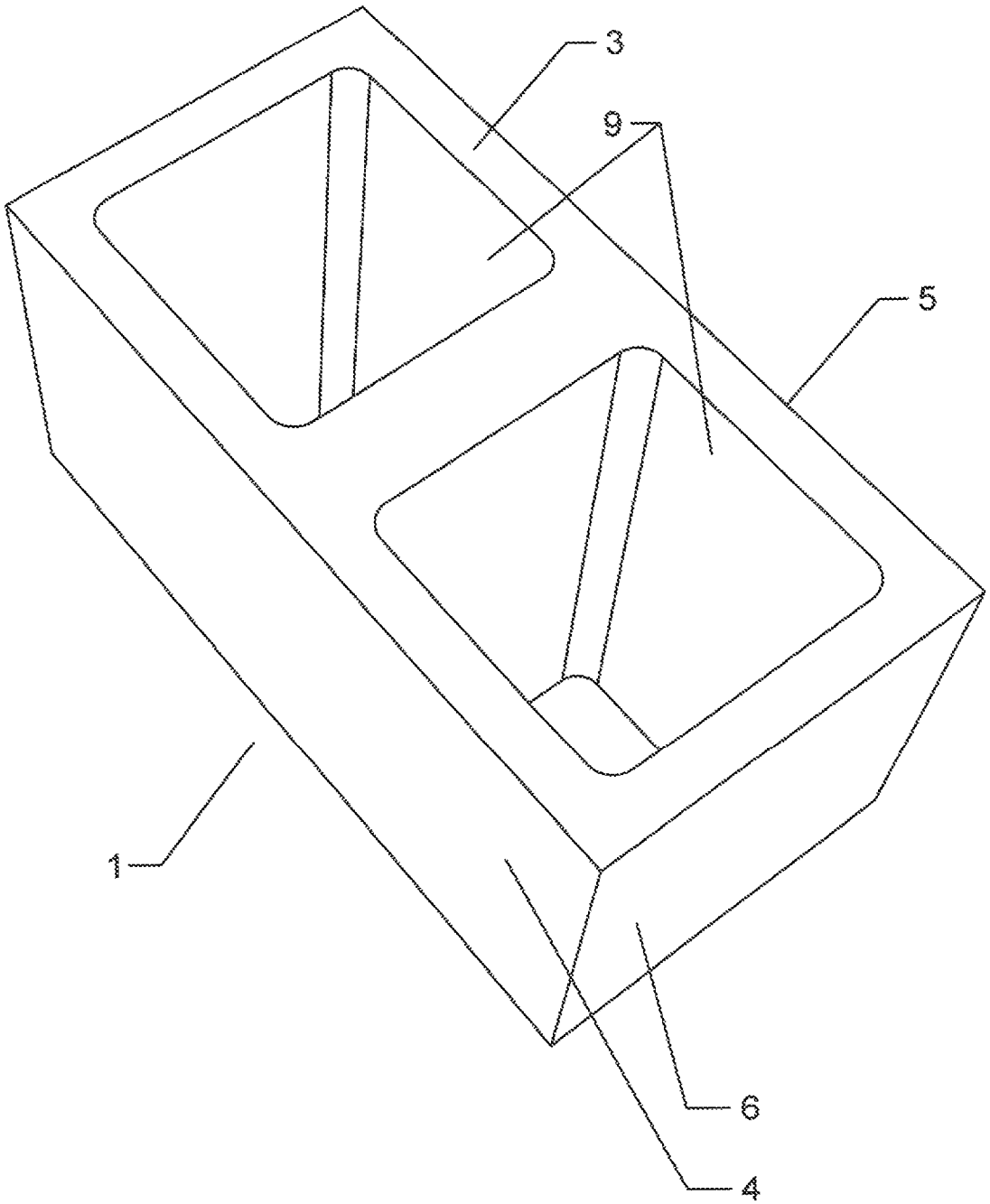
FIG. 2 is a bottom right perspective view of the full-size interlocking block.

FIG. 1 illustrates the full-size interlocking block (FIB) 1 from the top and FIG. 2 shows the same block from the bottom. Full-size interlocking block (FIB) 1 has a top face of FIB 2, a bottom face of FIB 3, a front face of FIB 4, a back face of FIB 5, and side walls of FIB 6. Opposing faces of full-size interlocking block (FIB) 1 and opposing side walls of FIB 6 are generally parallel to each other. Raised, tapered bosses of FIB 7 extend above top face of FIB 2 and end at the top faces of bosses of FIB 8. Full-size interlocking block (FIB) 1 has two passages of FIB 9 defined therethrough. In some embodiments, full size interlocking block (FIB) 1 may have one or more than two passages therethrough. The openings of passages of FIB 9 in top faces of bosses of FIB 8 are smaller than the openings of passages of FIB 9 in the bottom face of FIB 3, because passages of FIB 9 taper inward from bottom to top. Bosses of FIB 7 engage with the openings of passages in way of the bottom face of adjacent full-size interlocking block (FIB) 1 or half-size interlocking block (HIB) 10. Bosses of FIB 7 may also engage with the recesses of CIB 29 in cap interlocking block (CIB) 20.

Figure 3:
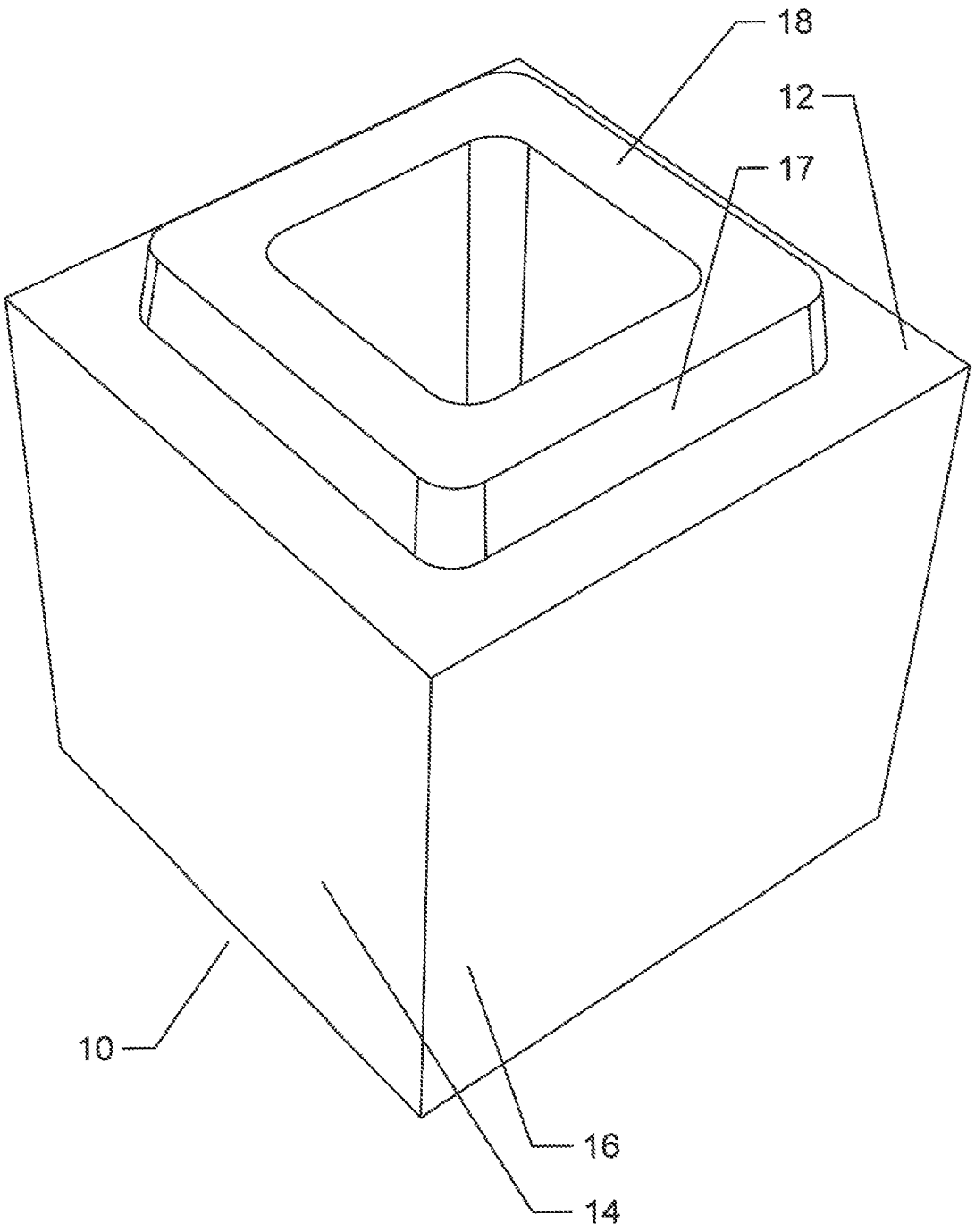
FIG. 3 is a top right perspective view of the half-size interlocking block.
Figure 4:
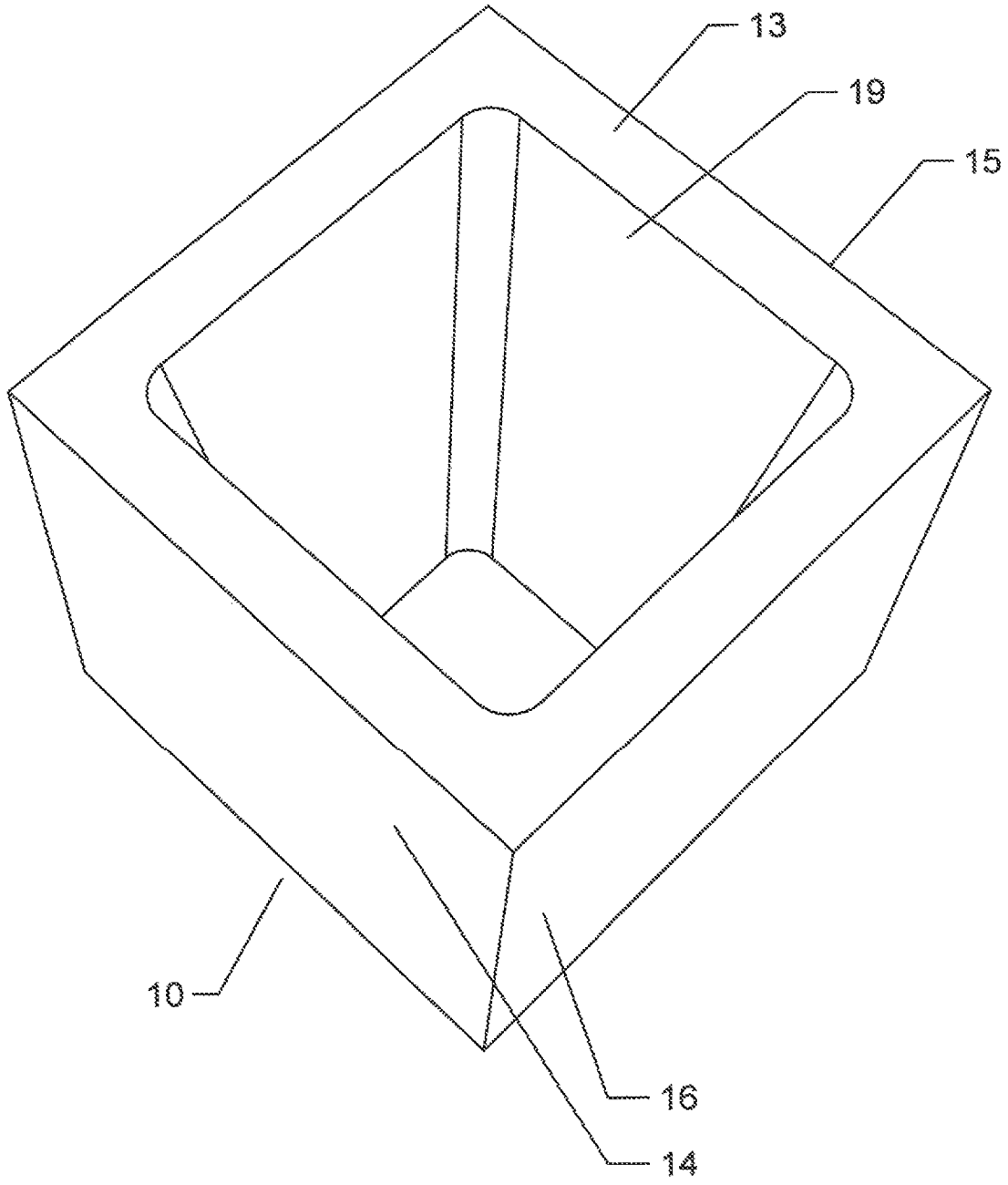
FIG. 4 is a bottom right perspective view of the half-size interlocking block.

FIG. 3 illustrates the half-size interlocking block (HIB) 10 from the top and FIG. 4 shows the same block from the bottom. Half-size interlocking block (HIB) 10 has a top face of HIB 12, a bottom face of HIB 13, a front face of HIB 14, a back face of HIB 15, and side walls of HIB 16. Opposing faces of half-size interlocking block (HB) 10 and opposing side walls of HIB 16 are generally parallel to each other. A raised, tapered boss of HIB 17 extends above top face of HIB 12 and ends at the top face of boss of HIB 18. Half-size interlocking block (HIB) 10 has a passage of HIB 19 defined therethrough. In some embodiments, half-size interlocking block (HIB) 10 may have more than one passages therethrough. The opening of passage of HIB 19 in top face of boss of HIB 18 is smaller than the opening of passage of HIB 19 in the bottom face of HIB 13, because passage of HIB 19 tapers inward from bottom to top. Boss of HIB 17 engages in the opening of passage in way of the bottom face of adjacent full-size interlocking block (FIB) 1 or half-size interlocking block (HIB) 10. Boss of HIB 17 may also engage with a recess of CIB 29 in cap interlocking block (CIB) 20.

Figure 5:
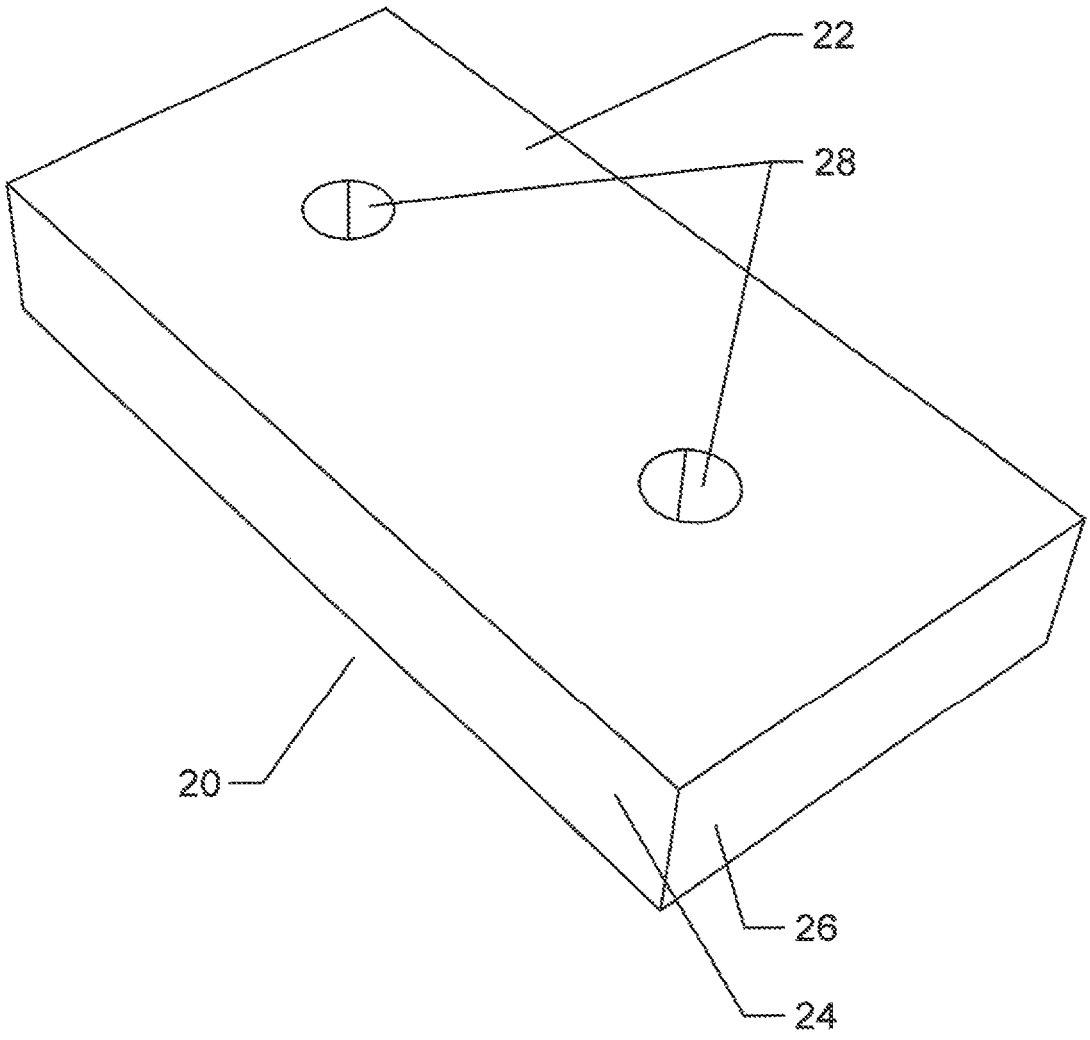
FIG. 5 is a top right perspective view of the cap interlocking block.
Figure 6:
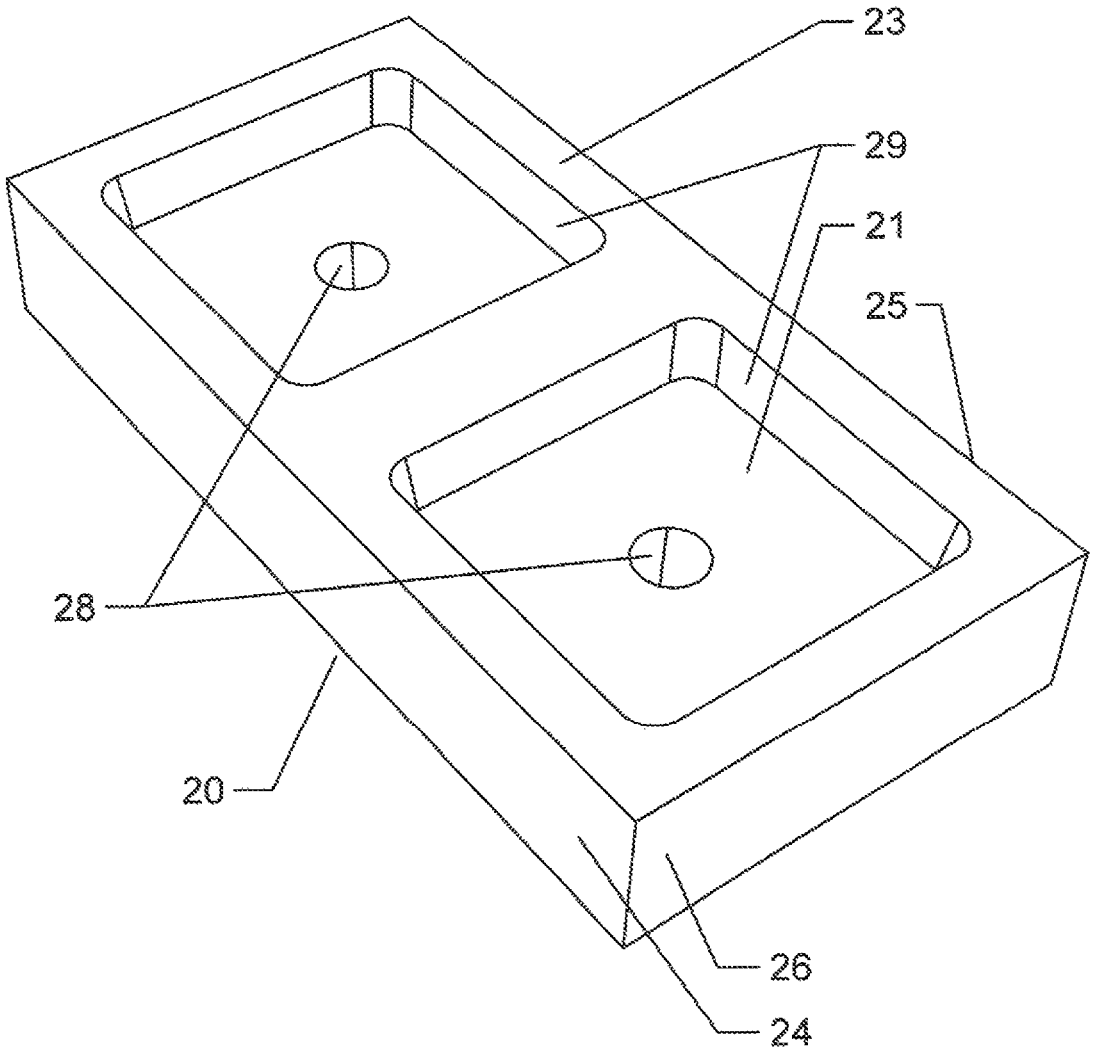
FIG. 6 is a bottom right perspective view of the cap interlocking block.

The cap interlocking block (CIB) 20 is illustrated from the top in FIG. 5 and from the bottom in FIG. 6. Cap interlocking block (CIB) 20 has a top face of CIB 22, a bottom face of CIB 23, a front face of CIB 24, a back face of CIB 25, and side walls of CIB 26. Opposing faces of cap interlocking block (CIB) 20 and opposing side walls of CIB 26 are generally parallel to each other. Cap interlocking block (CIB) 20 has two recesses of CIB 29 that begin at the bottom face of CIB 23 and end at the top of recesses of CIB 21. Recesses of CIB 29 receive the bosses of full-size interlocking block (FIB) 1 or half-size interlocking block (HIB) 10 or base interlocking block (BIB) 30. In some embodiments, cap interlocking block (CIB) 20 may have one or more than two recesses therein. The cap interlocking block (CIB) 20 has two passages for tendon of CIB 28 located in way of the centerline of recess of CIB 29, extending from top of recesses of CIB 21 to top face of CIB 23. The passages for tendon of CIB 28 facilitate insertion of tendon 66. In some embodiments, cap interlocking block (CIB) 20 may have one or more than two passages for tendon therethrough.

Figure 7:
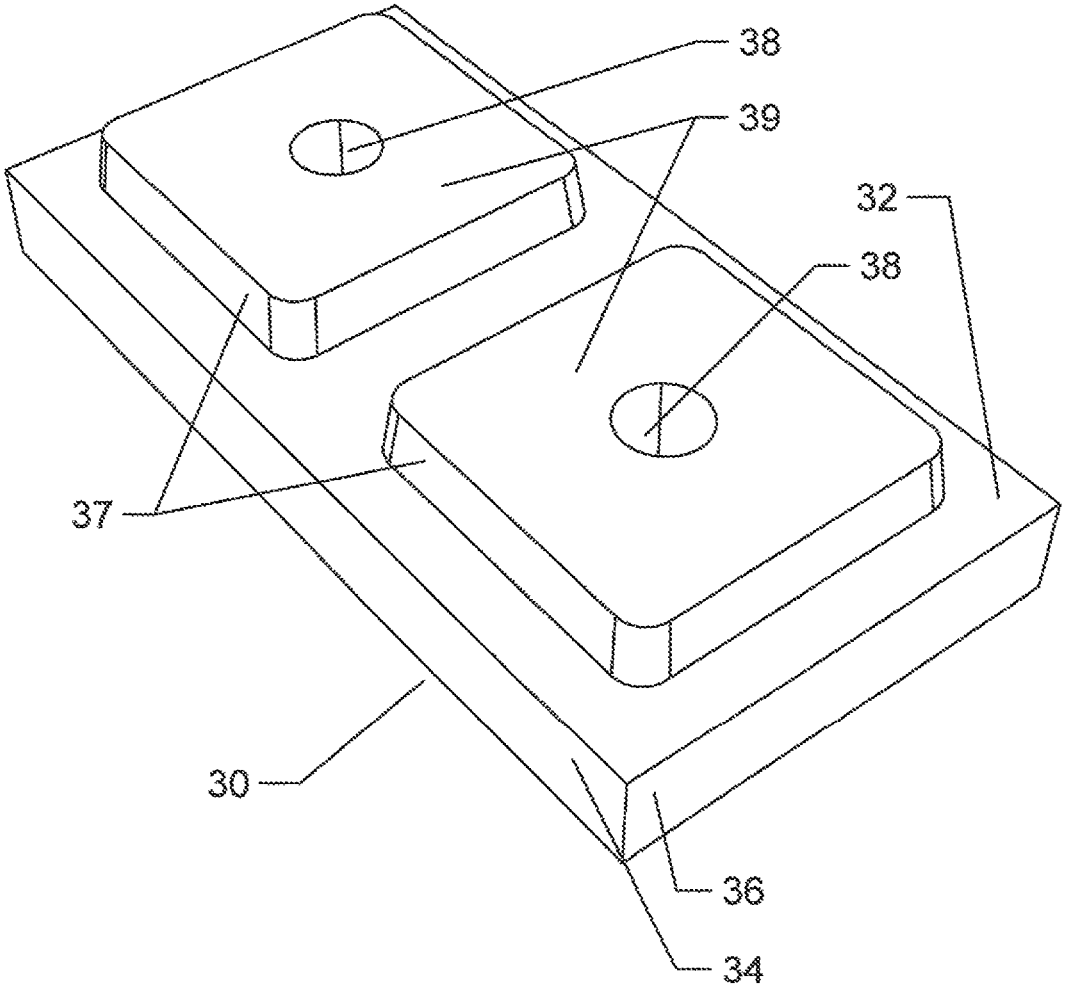
FIG. 7 is a top right perspective view of the base interlocking block.
Figure 8:
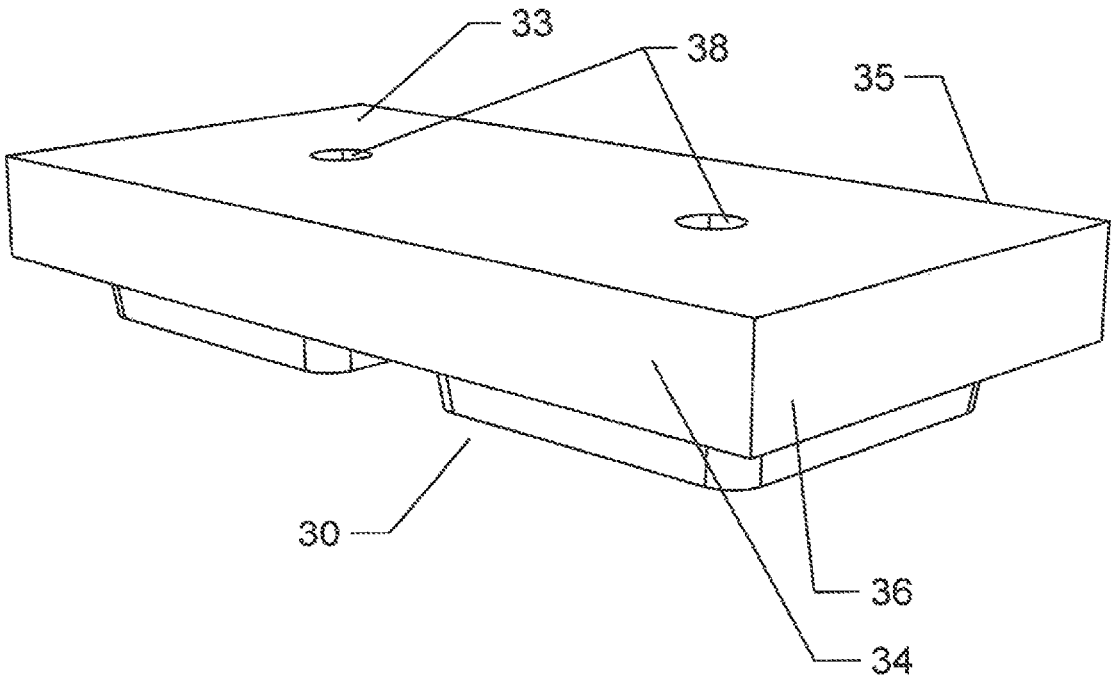
FIG. 8 is a bottom right perspective view of the base interlocking block.

The base interlocking block (BIB) 30 is shown from the top in FIG. 7 and from the bottom in FIG. 8. Base interlocking block (BIB) 30 has a top face of BIB 32, a bottom face of BIB 33, a front face of BIB 34, a back face of BIB 35, and side walls of BIB 36. Opposing faces of base interlocking block (BIB) 20 and opposing side walls of BIB 36 are generally parallel to each other. The top of BIB 32 has two, raised, tapered bosses of BIB 37 formed thereon that couple with the bottom openings of passages of full-size interlocking block (FIB) 1 and/or half-size interlocking (HIB) block 10. Bosses of BIB 37 may also engage with a recesses of cap interlocking block (CIB) 20. In some embodiments, base interlocking block (BIB) 30 may have one or more than two bosses thereon. The base interlocking block (BIB) 30 has two passages for tendon of BIB 38 located in way of the centerlines of the two bosses of BIB 37, extending from the bottom face of BIB 33 to the top faces of bosses of BIB 39 to facilitate insertion of ends of tendon 66, j-bolt anchor 52, expansion bolt anchor 54, or earth anchor 56. In some embodiments, base interlocking block (BIB) 30 may have one or more than two passages for tendon therethrough.

Figure 9:
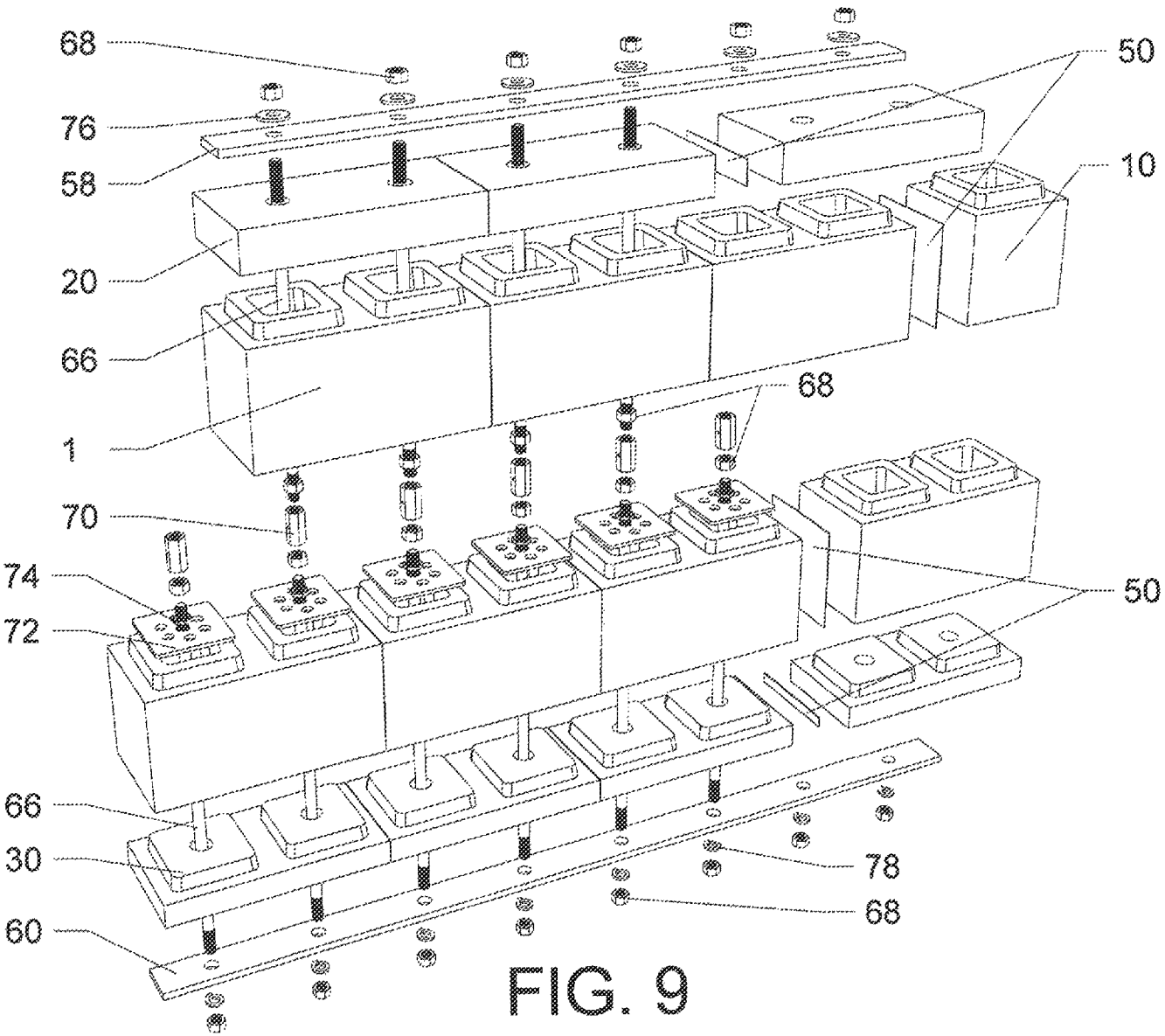
FIG. 9 is an exploded view of the principal components of the present invention.

The interrelation of the principal components of the present invention is shown in the exploded view in FIG. 9. In this embodiment, rows of full-size interlocking block (FIB) 1 and half-size interlocking block (HIB) 10 are laid on base interlocking block (BIB) 30. Each row of full-size interlocking block (FIB) 1 is staggered relative to adjacent rows, so that each boss and each passage or recess engages with a different block. This maximizes the integration of the wall, since every full-size interlocking block (FIB) 1 is interconnected with four other blocks. Above the top row of full-size interlocking block (FIB) 1 and half-size interlocking block (HIB) 10 is a course of cap interlocking block (CIB) 20 to close the top of the structure. Tendon 66 that starts below bottom beam 60 under base interlocking block (BIB) 30 passes through rows of full-size interlocking block (HIB) 1 and terminates above top beam 58 above cap interlocking block (CIB) 20. Lengths of tendon 66 shorter than the span between the base interlocking block (BIB) 30 and cap interlocking block (CIB) 20 are joined by tendon couplings 70 to expedite the laying of rows of full-size interlocking block (FIB) 1 and/or half-size interlocking block (HIB) 10 over tendon 66. Nut 68 located above and below each tendon coupling 70 are tightened to the tendon coupling 70 to torsionally lock each joint. Below each tendon coupling 70 is build stop 72, which is held in place on tendon 66 by tensioning build stop nut 74. Some embodiments of build stop 72 may be plastic sheet, plywood, or metal sheet. Build stop 72 stabilizes the wall during construction by helping to prevent movement or dislodging of the interlocking blocks. Build stop 72 also holds tendon 66 in the center of the opening in the interlocking block to facilitate coupling to the adjacent section of tendon 66. Build stop 72 may be left inside the wall after construction, since it will not interfere with post-tensioning of the structure. The top of each threaded end of tendon 66 is secured with a flat washer 76 and nut 68 in way of top beam 58 above cap interlocking block (CIB) 20. The bottom of each threaded end of tendon 66 is secured with a lock washer 78 and nut 68 in way of bottom beam 60 below base interlocking block (BIB) 30. Seal ply 50 is inserted or applied between the vertical ends of adjacent blocks to reduce the possibility of air or water to flow through this lacuna. In some embodiments, seal ply 50 may be expanded polyethylene foam, expanded polystyrene foam, cork sheet, or polymer sealing paste.

Figure 10:
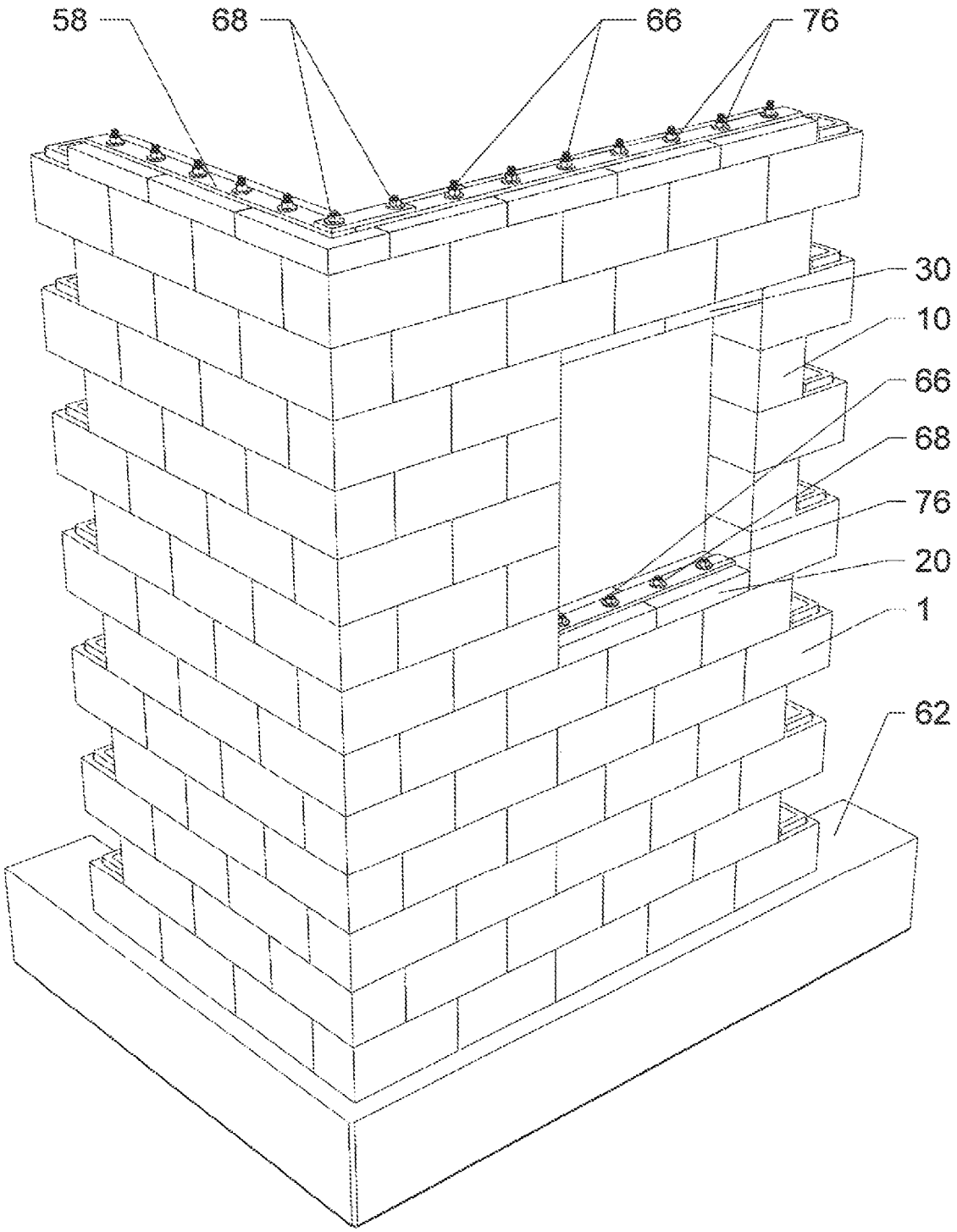
FIG. 10 is a left perspective view of the exterior of a structure that utilizes the present invention.
Figure 11:
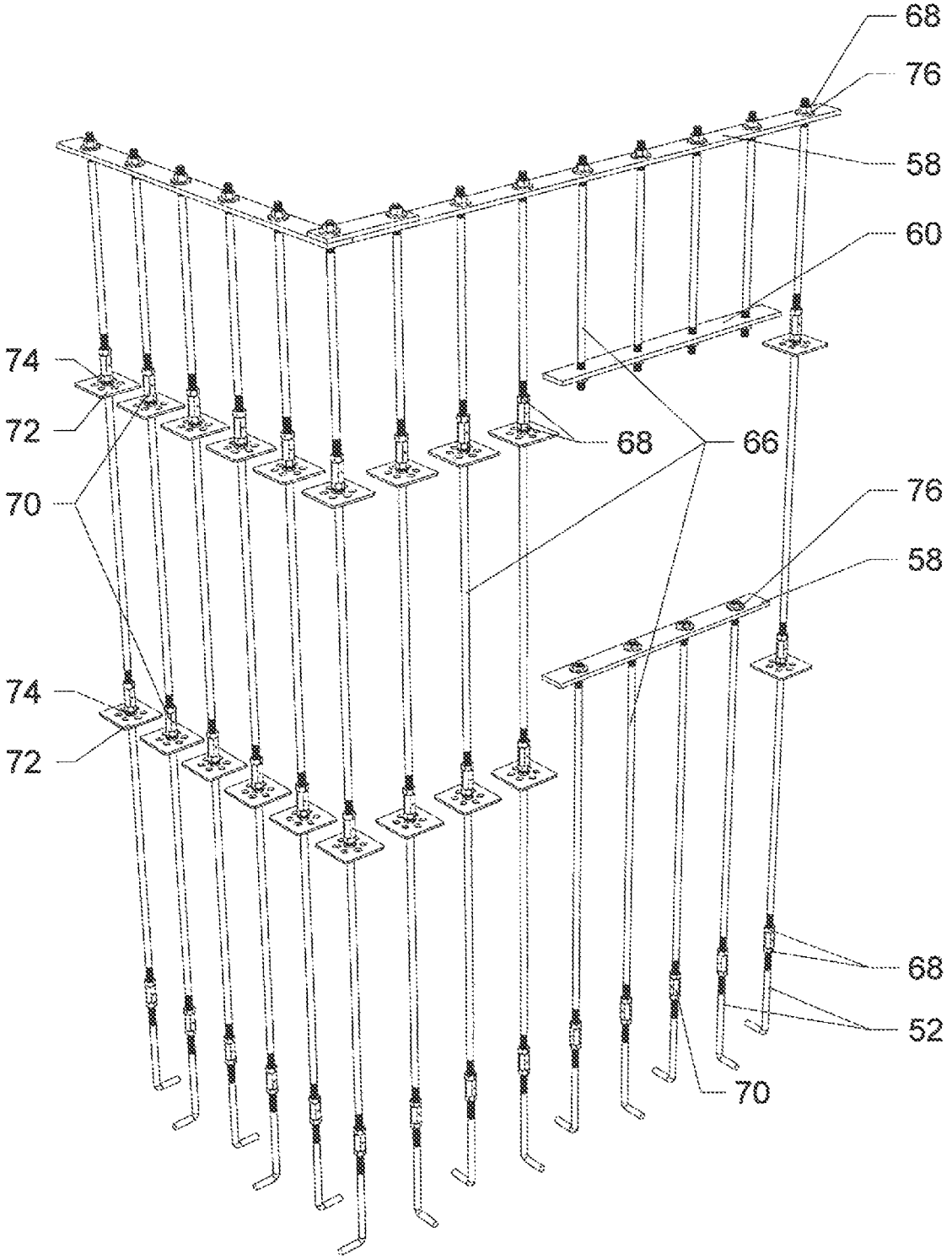
FIG. 11 is a left perspective view of the internal elements of a structure that utilizes the present invention.
Figure 12:
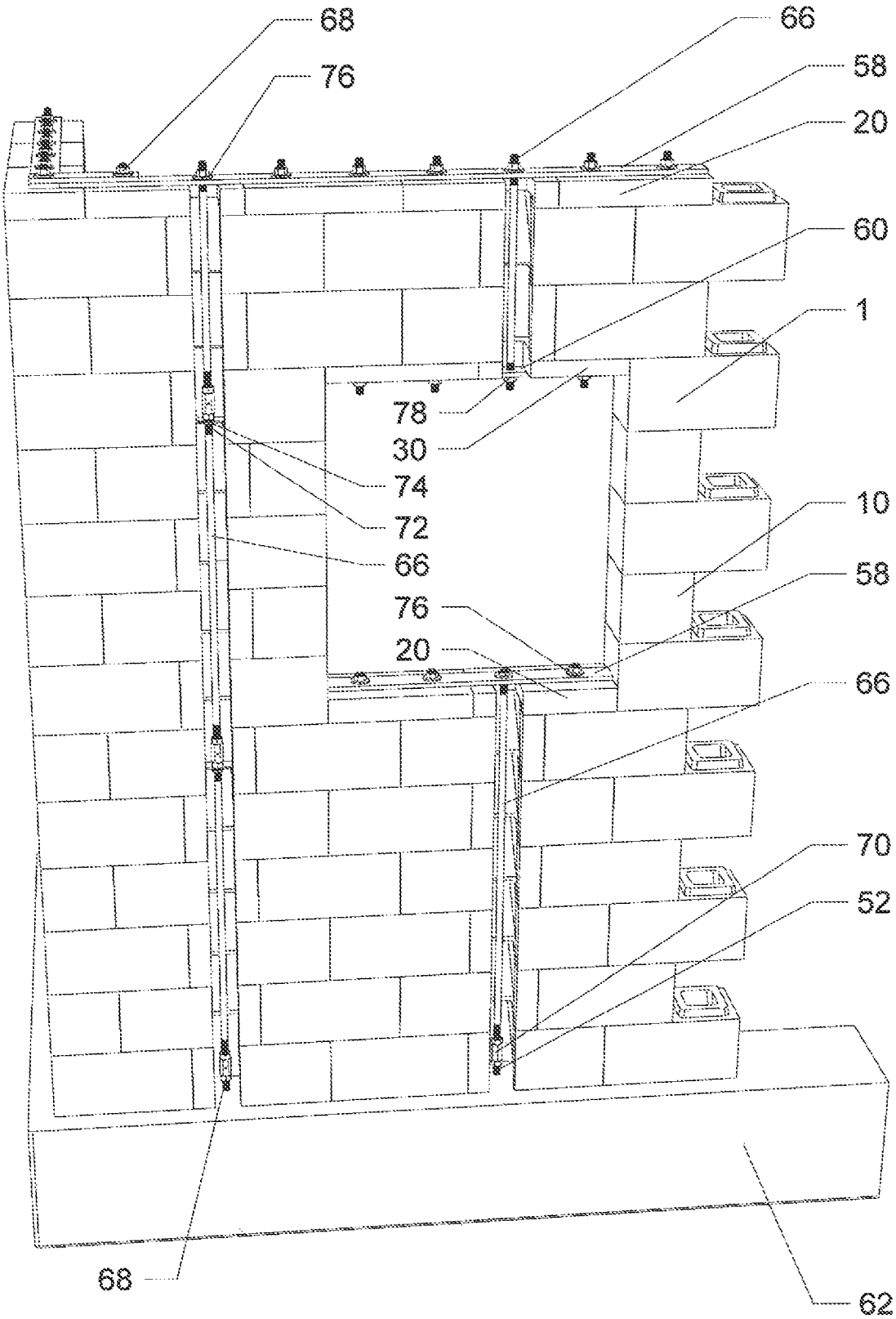
FIG. 12 is a cutaway view of a structure that utilizes the present invention.

The corner of a building structure fabricated through utilization of the present invention is illustrated in FIG. 10-12. FIG. 10 shows the exterior of the building structure. FIG. 11 displays the internal elements of the structure without the blocks. These elements include J-bolt anchor 52, top beam 58, tendon 66, nut 68, tendon coupling 70, build stop 72, build stop nut 74, and flat washer 76. The internal elements of the structure would most often be made from structural steel. Alternate embodiments of these internal elements include aluminum, fiberglass reinforced plastic, carbon fiber reinforced plastic, semi-crystalline polyamides, and fiber-filled nylon. FIG. 12 illustrates representative elements in the wall structure with the blocks cut away. In this embodiment, walls are laid on concrete foundation 62 instead of on base interlocking block (BIB) 30. J-bolt anchor 52 are positioned inside concrete foundation 62 when the material of which concrete foundation 62 is made has partially cured. Tendon 66 are connected to j-bolt anchor 52 with tendon coupling 70. Tendon 66 are torsionally locked by nut 68 above and below each tendon coupling 70.

The opening shown in FIG. 10 and FIG. 12 is typical of any opening in a building structure that utilizes the present invention. Some embodiments of these openings would be windows, doors, and façades. The bottom or sill of the opening is formed from cap interlocking block (CIB) 20 that cover and interconnect with the full-size interlocking block (FIB) 1 and/or half-size interlocking block (HIB) 10 below the opening. Top beam 58 on cap interlocking block (CIB) 20 is the end plate for tendon 66 that extend up from concrete foundation 62. Each tendon 66 that terminates at the sill of the opening is secured and tensioned with nut 68, which sits on flat washer 76. The top or header of the opening is formed from base interlocking block (BIB) 30 that covers and interconnects with full-size interlocking block (FIB) 1 and/or half-size interlocking block (HIB) 10 above the opening. Bottom beam 60 below base interlocking block (BIB) 30 is the end plate for tendon 66 that extends upward through the top of the wall. Each tendon 66 that terminates at the header is secured and tensioned with nut 68, which engages lock washer 78.

The sides of openings in the building structure are closed with half-size interlocking block (HIB) 10 when necessary. Since the full-size interlocking block (FIB) 1 are laid in staggered courses, gaps in way of the opening will need to be filled with half-size interlocking block (HIB) 10.

Figure 13:
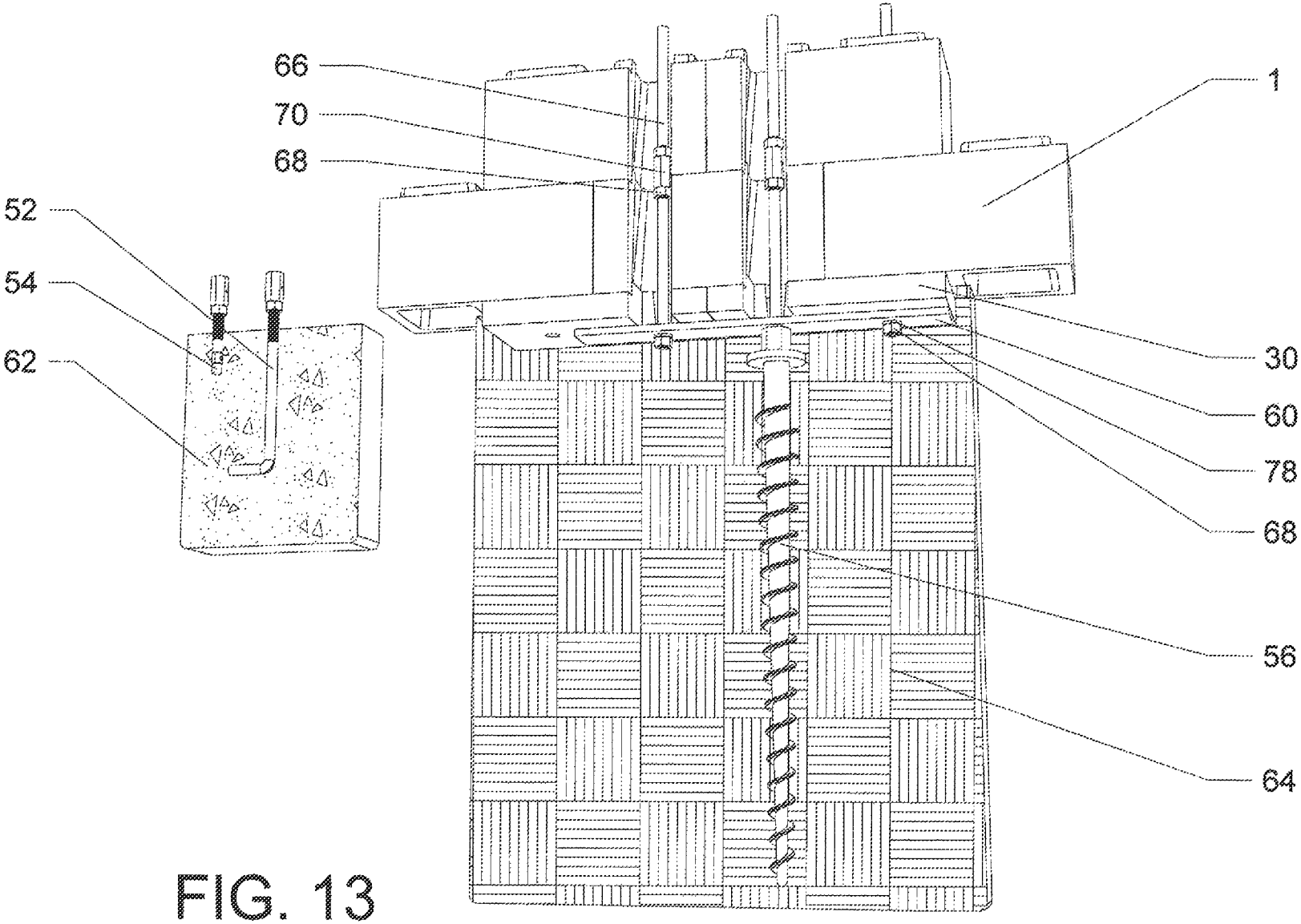
FIG. 13 is a cutaway view of embodiments of the base of a structure that utilizes the present invention.

FIG. 13 illustrates several possible embodiments of the bottom of walls of building structures made with the present invention. All embodiments provide a means of securing the bottom of tendon 66. If concrete foundation 62 is used, anchor bolts may be inserted before or after the material has cured of which concrete foundation 62 is made. J-bolt anchor 52 or equal would be inserted in a partially cured concrete foundation 62. Expansion bolt anchor 54 or equal would be inserted in a fully cured concrete foundation 62. Concrete foundation 62 may be either a footing in way of the walls of the building structure, a slab under the entire building structure, or a reinforced-concrete beam. In lieu of concrete foundation 62, elevated buildings or buildings spanning a gap could utilize bottom beam 60 sized for the requisite structural loads and the dead weight of the building structure. If concrete foundation 62 is not utilized, the walls of the shell may rest upon soil foundation 64. In this embodiment, the full-size interlocking block (FIB) 1 are stacked on a leveled course of base interlocking block (BIB) 30. Below base interlocking block (BIB) 30 is bottom beam 60 into which the ends of tendon 66 are affixed. In order to connect the building structure to the substrate on which the structure sits, earth anchor 56 may be used. Earth anchor 56 may connect to the threaded end of tendon 66 with a thread tapped joint in the top of earth anchor 56 or by using tendon coupling 70 that is torsionally locked with nut 68 above and below tendon coupling 70. When inserted into a substrate that has been mechanically compacted, the pull-out strength of earth anchor 56 can exceed that of j-bolt anchor 52 or expansion bolt anchor 54.

With respect to the above description, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An integrated, post-tensioned building construction system to form walls, comprising in combination:

a plurality of first blocks, each of the first blocks having a body with a front face, a rear face, a top face, a bottom face, generally parallel side walls, with a first tapered passage and a second tapered passage defined therethrough, with an opening at the top and bottom faces, and further including a first tapered boss integrally formed on the top face juxtaposed the first tapered passage extending from the top face of the first block and a second tapered boss integrally formed on the top face juxtaposed the second tapered passage extending from the top face of the first block;

a plurality of second blocks, each of the second blocks having a body with a front face, a rear face, a top face, a bottom face, generally parallel side walls, with a tapered passage defined therethrough, with an opening at the top and bottom faces, and further including a tapered boss integrally formed on the top face juxtaposed the tapered passage extending from the top face of the second block;

a plurality of cap blocks, each of the cap blocks having a body with a front face, a rear face, a top face, a bottom face, generally parallel side walls, one or more recesses defined in the bottom face, with passages defined therethrough;

a plurality of base blocks, each of the base blocks having one or more passages defined therethrough;

a top beam positioned above the cap blocks;

a bottom beam positioned below the base blocks;

a series of tendons, each of the tendons having a threaded first end and a threaded second end, and each tendon being connected to another one of the tendons at the ends, oriented vertically through passages of the first blocks, the passages of the second blocks, the passages of the cap blocks, and the passages of the base blocks; and secured at the first end of the series of tendons to the bottom beam and secured at the second end of the series of tendons to the top beam; and a first nut and a first bolt for tightening the series of tendons to the bottom beam, and a second nut and a second bolt for securing the top beam to the cap blocks.

2. The system as set forth in claim 1, whereby the bosses of the first blocks and the bosses of the second blocks are dimensioned to securely mate with either the first blocks or the second blocks within the passages of the first blocks or the second blocks.

3. The system as set forth in claim 1, whereby the recesses of the cap blocks are dimensioned to securely mate with the bosses of the first blocks or the bosses of the second blocks.

4. The system as set forth in claim 1, whereby the base blocks have a body with a front face, a rear face, a top face, a bottom face, generally parallel side walls, a pair of bosses integrally formed on, and extending from, the top face, with passages defined therethrough; and whereby the bosses of the base blocks are dimensioned to securely mate with either the passages of the first blocks or the passages of the second blocks.

5. The system as set forth in claim 4, further comprising tendon couplings having first and second opposite ends threadably secured at the ends to the ends of the tendons, and further having a pair of nuts at the opposite ends of the tendon coupling to torsionally lock the tendon coupling.

6. The system as set forth in claim 5, further comprising a build stop having a generally rectangularly shaped body mounted perpendicularly to the tendon couplings by a build stop nut to expedite laying of rows of the first blocks and the second blocks in alignment with the series of tendons.

7. The system as set forth in claim 6, further comprising an anchor embedded in a concrete foundation before or after the concrete of the foundation has cured whereby the first end of one of the series of tendons is connected to the anchor.

8. The system as set forth in claim 6, further comprising an anchor embedded in a soil foundation whereby the first end of one of the tendons is connected to the anchor.

9. The system as set forth in claim 6, further comprising seal ply inserted or applied between the side walls of adjacent ones of the first and second blocks.

10. An integrated, post-tensioned building construction system to form walls, comprising in combination:

a plurality of first blocks, each of the first blocks having a body with a front face, a rear face, a top face, a bottom face, generally parallel side walls, with a first tapered passage and a second tapered passage defined therethrough, with an opening at the top and bottom faces, and further including a first tapered boss integrally formed on the top face juxtaposed the first tapered passage extending from the top face of the first block and a second tapered boss integrally formed on the top face juxtaposed the second tapered passage extending from the top face of the first block;

a plurality of second blocks, each of the second blocks having a body with a front face, a rear face, a top face, a bottom face, generally parallel side walls, with a tapered passage defined therethrough, with an opening at the top and bottom faces, and further including a tapered boss integrally formed on the top face juxtaposed the tapered passage extending from the top face of the second block;

a plurality of cap blocks, each of the cap blocks having a body with a front face, a rear face, a top face, a bottom face, generally parallel side walls, one or more recesses defined in the bottom face, with passages defined therethrough;

a top beam positioned above the cap blocks;

a series of tendons, each of the tendons having a threaded first end and a threaded second end, and each tendon being connected to another one of the tendons at the ends, oriented vertically through passages of the first blocks, the passages of the second blocks, and the passages of the cap blocks; and secured at the first end of the series of tendons to the to the top beam;

a first nut and a first bolt for securing the top beam to the cap blocks; and a J-bolt anchor embedded in a concrete foundation before the concrete of the foundation has cured whereby the first end of one of the of tendons is connected to the anchor with one of the tendon couplings.

11. A method for constructing post-tensioned structures for forming a wall, comprising the steps of:

arranging a series of first blocks, each of the first blocks having a body with a front face, a rear face, a top face, a bottom face, generally parallel side walls, with a first tapered passage and a second tapered passage defined therethrough, with an opening at the top and bottom faces; and a series of second blocks, each of the second blocks having a body with a front face, a rear face, a top face, a bottom face, generally parallel side walls, with a tapered passage defined therethrough, with an opening at the top and bottom faces, and further the first blocks and second blocks aligned parallel to each first block or second block to form the wall;

positioning a series of cap blocks each of the cap blocks having a body with a front face, a rear face, a top face, a bottom face, generally parallel side walls, one or more recesses defined in the bottom face, with passages defined therethrough above the first blocks and second blocks forming the wall;

positioning a series of base blocks, each of the base blocks having one or more passages defined therethrough, on a structural foundation below the wall;

positioning a top beam on the wall above the cap blocks;

positioning a bottom beam below the base blocks; and aligning a series of orienting tendons, each of the tendons having a top threaded end and a bottom threaded end, through the passages of the first blocks, the second blocks, the cap blocks and the base blocks, and further connecting the tendons to the top beam at the top threaded ends of the tendons and to the bottom beam at the bottom threaded ends by torqueing a first nut and a first bolt to the top threaded ends, and torqueing a second nut and a second bolt to the bottom threaded ends.

* * * * *